US005803422A

United States Patent [19]

Buehler

[11] Patent Number: 5,803,422

[45] Date of Patent: Sep. 8, 1998

[54] TOOL AND PARTS TRAY

[76] Inventor: Dieter Buehler, 13303 Judah Ave., Hawthorne, Calif. 90250

[21] Appl. No.: 847,131

[22] Filed: Apr. 30, 1997

[51] Int. Cl.[6] ..... B42F 13/00

[52] U.S. Cl. ..... 248/339; 248/215; 206/375

[58] Field of Search ..... 248/339, 238, 248/210, 215, 206.5, 317, 322, 323, 309.4, 310, 243; 211/88, 70.6; 206/375, 373, 372, 349, 350, 552

[56] References Cited

U.S. PATENT DOCUMENTS

| | | | |
|---|---|---|---|
| 604,549 | 5/1898 | Spencer | 294/143 |
| 768,364 | 8/1904 | Hines | 220/23.4 |
| 3,822,847 | 7/1974 | Emmons | 248/210 |
| 3,829,051 | 8/1974 | Emmons | 248/238 |
| 4,310,134 | 1/1982 | Schopp et al. | 248/210 |
| 4,316,545 | 2/1982 | Hartnell | 211/60 T |
| 4,445,659 | 5/1984 | LaChance | 248/210 |
| 4,489,911 | 12/1984 | Riley | 248/238 |
| 4,653,713 | 3/1987 | Hamilton | 248/238 |
| 4,714,158 | 12/1987 | Oltman et al. | 206/349 |
| 4,826,059 | 5/1989 | Bosch et al. | 224/183 |
| 4,979,710 | 12/1990 | Baldwin | 248/210 |
| 5,078,281 | 1/1992 | Johnson | 211/88 |
| 5,135,193 | 8/1992 | Parris | 248/238 |
| 5,331,904 | 7/1994 | DiSimone et al. | 108/44 |
| 5,370,263 | 12/1994 | Brown | 220/751 |
| 5,398,809 | 3/1995 | Henke et al. | 206/373 |
| 5,429,205 | 7/1995 | Collins | 182/122 |
| 5,511,674 | 4/1996 | Boyd et al. | 211/70.6 |
| 5,699,910 | 12/1997 | Kubat | 206/373 |
| 5,711,428 | 1/1998 | Ho | 206/738 |

*Primary Examiner*—Leslie A. Braun
*Assistant Examiner*—Tan R. Le
*Attorney, Agent, or Firm*—Edward E. Roberts

[57] ABSTRACT

A tool and parts tray having a shallow tray base, formed of bent and welded sheet metal, with first and second generally identical suspension strap members formed of sheet metal bent and configured for securing, such as by welding, to the bottom and adjacent side of the tray base. The lower ends of the suspension strap members are triangularly configured to provide a base portion of the triangle for affixing to the bottom, a leg portion perpendicular to the bottom and a hypotenuse portion providing bracing to the leg portion. The other end of the suspension strap member is disposed at a right angle to the leg portion. First and second generally identical L-shaped members formed of sheet metal are adjustably attached at the suspension ends of the suspension straps to form a hook for positioning over a suitable support, such as a cross beam of a hydraulic vehicle lift. A tool and parts holding means is provide in the form of depressions in the tray bottom or by means of magnetic strips in the tray bottom.

15 Claims, 2 Drawing Sheets

TOOL AND PARTS TRAY

BACKGROUND OF THE INVENTION

1. Field of the Invention

This invention relates to receptacles, and more particularly to a tray for holding tools and parts for use by a mechanic, or the like.

2. Description of the Prior Art

Garage mechanics generally have a tool chest for storage of tools. However, when working on a specific task on an automobile elevated on a rack, generally only a few select tools are required. Moreover, in many such repair facilities, due to restricted floor space and other equipment, it is not convenient to have the tool chest adjacent the vehicle on which work is being performed. The mechanic may have the tools on a nearby surface, such as a table, may have some of the tools in the pocket of his uniform, or may place the tools in locations on or about the vehicle lift or rack. In addition, during the repair, parts may be removed or added, along with fasteners, such as nuts and bolts, in which event it would be helpful to have such items readily available.

One such assist device is shown and described in U.S. Pat. No. 4,316,545, entitled "Hanging Tool Tray", issued to Hartnell on Feb. 23, 1982. The apparatus consists of a shallow bin, supported at the four corners by flexible cables, which are secured together at a point whereupon a hanger type hook is attached. While providing a measure of convenience, due to the flexible suspension, such a device is susceptible to swinging when suspended from a rack or other device.

In accordance with a feature of the present invention, there is provided a new and improved tool and parts tray of economical construction, having a rigid, adjustable suspension system.

SUMMARY OF THE INVENTION

The foregoing and other objects of the invention are accomplished by providing a tool and parts tray having a shallow tray base, formed of bent and welded sheet metal, with first and second generally identical suspension strap members formed of sheet metal bent and configured for securing, such as by welding, to the bottom and adjacent side of the tray base. The lower ends of the suspension strap members are triangularly configured to provide a base portion of the triangle for affixing to the bottom, a leg portion perpendicular to the bottom and a hypotenuse portion providing bracing to the leg portion.

The other end of the suspension strap member is disposed at a right angle to the leg portion. First and second generally identical L-shaped members formed of sheet metal are adjustably attached at the suspension ends of the suspension straps to form a hook for positioning over a suitable support, such as a cross beam of a hydraulic vehicle lift.

A tool and parts holding means is provide in the form of depressions in the tray bottom or by means of magnetic strips in the tray bottom.

Other objects, features and advantages of the invention will become apparent on a reading of the specification when taken in conjunction with the drawings in which like reference numerals refer to like elements in the several views.

DESCRIPTION OF THE PREFERRED EMBODIMENT

Figure 1:
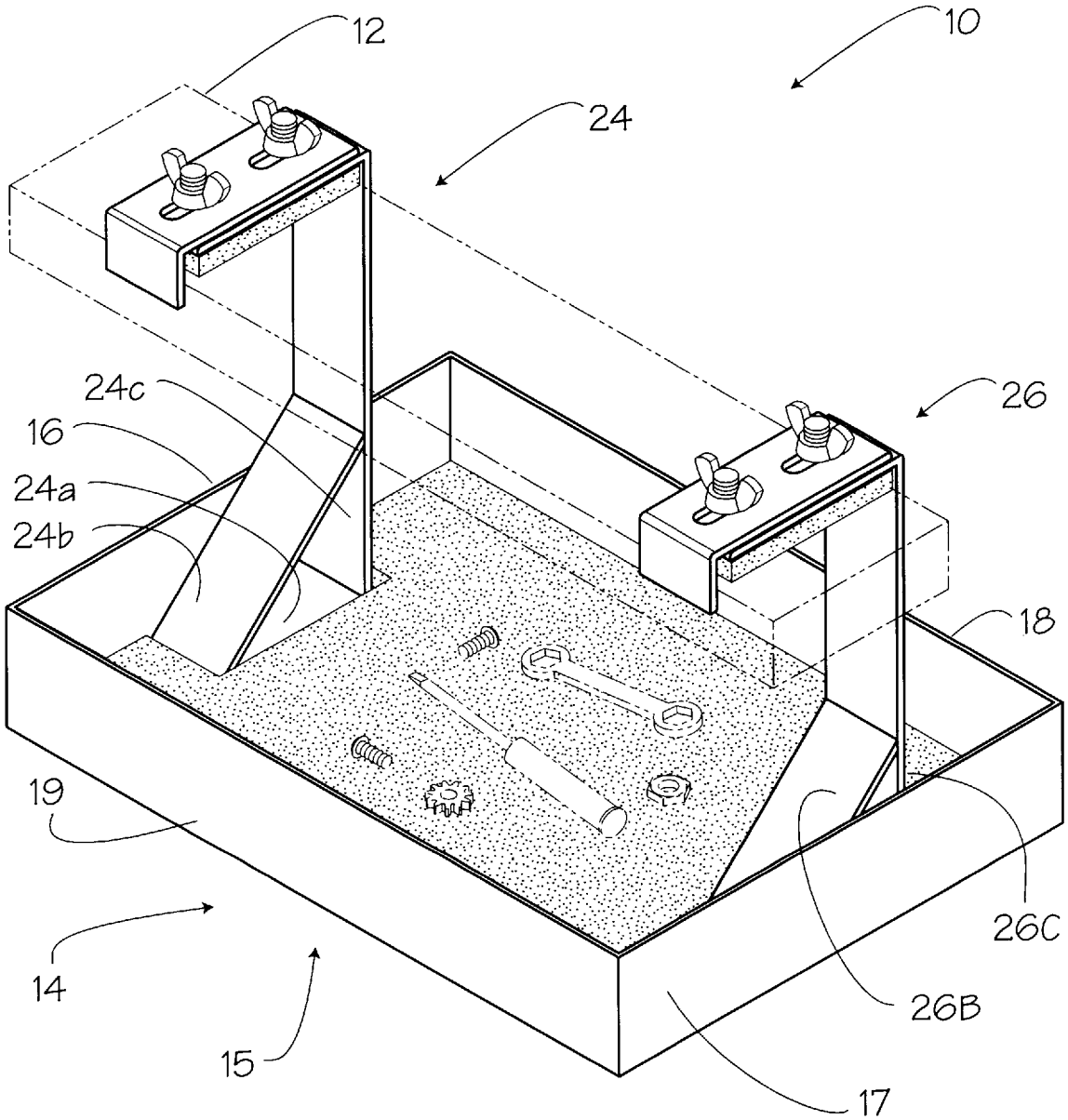
FIG. 1 is a perspective view of the tool and parts tray in accordance with the invention.
Figure 2:
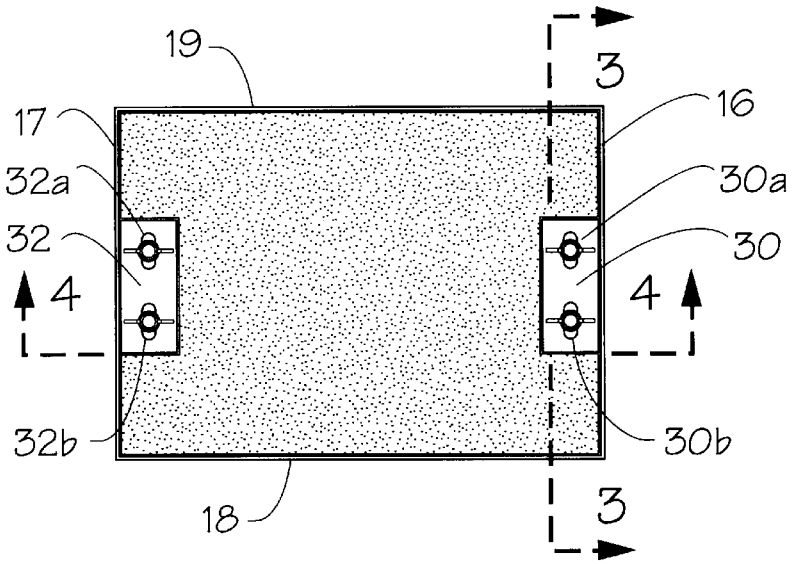
FIG. 2 is a top plan view of the tool and parts tray of FIG. 1.
Figure 4:
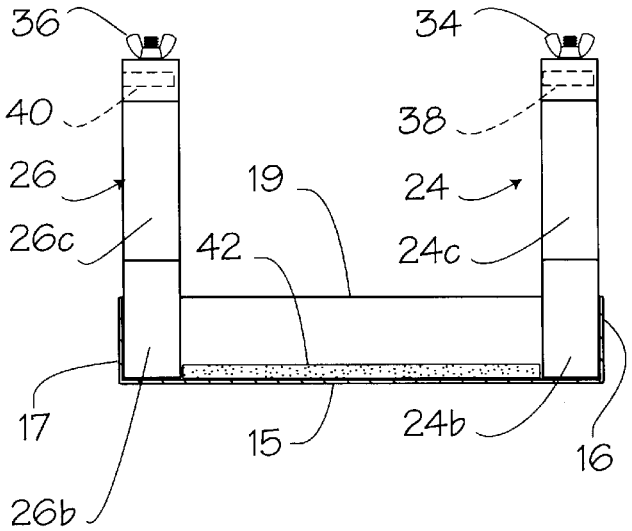
FIG. 4 is a side elevational view of the tool and parts tray of FIG. 1 as viewed from the bottom side of FIG. 2.
Figure 3:
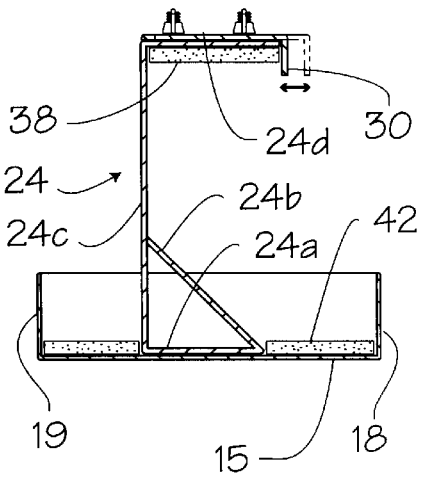
FIG. 3 is an end view of the tool and parts tray of FIG. 1 as view from the right side of FIG. 2.

Referring now to the drawings and particularly to FIG. 1, there is shown a tool and parts tray apparatus, generally designated 10, which is adapted for suspension from a cross beam or bar 12 (shown in phantom illustration) of an automobile vehicle lift or the like. The apparatus includes a shallow tray, generally designated 14, having a bottom 15 and two sets of opposing sides 16, 17 and 18,19 generally perpendicular to the bottom 15. The tray 14 is formed of stamped sheet metal bent to the desired configuration and welded at the four corners.

A pair of generally identically configured suspension strap members 24, 26 are formed from a single strap piece of bent sheet metal to provide a right triangular shape with a base portion 24*a* (and 26*a*), a hypotenuse portion 24*b* (and 26*b*) and a leg portion 24*c* (and 26*c*), the leg portion 24*c*, 26*c* being of a length which extends beyond the periphery of the hypotenuse portion 24*b*, 26*b* and having a support portion 24*d*, 26*d* at the distal end thereof, the portion 24*d*, 26*d* extending at right angles to the leg portion 24*c*, 26*c* and generally parallel to the base portion 24*a*, 26*a*.

The suspension strap members 24, 26 are secured, such as by welding the base portions 24*a*, 26*a* to the bottom 15 and welding the leg portions 24*c*, 26*c*, as well as the abutting portions of the hypotenuse portions 24*b*, 26*b* to the opposite side walls 16, 17, respectively. The triangular shape at the bottom of the suspension strap members 24, 26 provides structural rigidity and strength.

First and second generally identical L-shaped members 30, 32 are formed of bent sheet metal, with each having an elongate pair of axially aligned slots 30*a*, 30*b*, and 32*a*, 32*b*, respectively formed therein. The support portions 24*d*, 26*d* of the suspension strap members are provide with aligned apertures for passage therethrough of threaded fasteners, such as bolts and wing nuts 34, 36.

The fasteners pass through the apertures and through the aligned slots for permitting adjustment of the width of the hook end, thus formed when the L-shaped members are connected as shown in the drawings. To maintain the threaded bolts in position within the apertures, first and second foam pads 38, 40 are glued over the heads thereof on the underside of the support portions 24*d*, 26*d*, respectively.

Thus the L-shaped members may be readily adjusted to a desired hook size opening by simply loosening the wing nuts and tightening them at the desired position without requiring removal thereof.

For maintaining the parts and tools in position within the tray 14, suitable retention means may be provided. In one instance, the inside of the bottom 15 may have depressions (not shown) formed therein shaped for specific tools.

Alternatively, a flexible magnetic pad 42 or magnetic strips, can be positioned in the bottom 15 of the tray 14, are adjustably attached at the suspension ends of the suspension straps to form a hook for positioning over a suitable support, such as a cross beam of a hydraulic vehicle lift.

In accordance with the present invention there has been shown and described an tool and parts tray of economical compact construction. The description has proceeded with reference to an automobile mechanic's use, but it is to be understood that any craftsman or worker may utilize the device of the invention for suspending tools at a convenient height relative to the work being performed while providing ready access to tools and parts.

Although there has been shown and described a preferred embodiment, it is to be understood that other modifications may be made within the spirit and scope of the invention.

What is claimed is:

1. A tool and parts tray apparatus comprising:

a shallow tray member of generally rectangular configuration having a bottom and opposite pairs of sides formed of welded metal;

first and second generally elongate strap members welded to an opposite pair of sides on the inside of said tray member, said strap members having bar-shaped portions extending generally perpendicular to said bottom at the approximate midpoint thereof, said strap members having support portions at the distal ends thereof disposed generally parallel to said bottom; and first and second generally L-shaped bent metal members adjustably affixed to said first and second support portions, respectively, for forming a hook of a given size within a range of sizes.

2. The apparatus of claim 1 wherein said elongate strap members are bent into a triangular configuration for connection to the bottom and adjacent sides of said tray.

3. The apparatus of claim 2 wherein said strap members are secured to said tray by welding.

4. The apparatus of claim 1 wherein bolt members are provided for adjustably affixing said first and second generally L-shaped bent metal members to said first and second support portions and wherein said apparatus further includes foam pad means glued to said support portions over the heads of said bolt members.

5. The apparatus of claim 1 further including means for enabling retention of tools and parts within said tray.

6. The apparatus of claim 5 wherein said retention means includes magnetic means on said tray bottom.

7. The apparatus of claim 5 wherein said retention means includes formed depressions in the bottom of said tray.

8. A tool and parts tray apparatus comprising:

a shallow generally rectangular configured tray member having a bottom and opposite pairs of sides;

first and second generally identical elongate suspension members attached to said bottom and to an opposite pair of sides of said tray member;

said suspension members having the lower ends thereof triangularly configured to provide a base portion of the triangle for affixing to said bottom, and for affixing to said sides a leg portion perpendicular to the bottom and a hypotenuse portion providing bracing to said leg; and said leg portion extending generally perpendicularly from said tray and having attachment means at the distal ends thereof for attachment to a suitable support.

9. The apparatus of claim 8 wherein said attachment means is L-shaped for hooking over said suitable support.

10. The apparatus of claim 9 wherein said suitable support is a support beam of a vehicle lift.

11. The apparatus of claim 8 wherein said tray member is formed of bent and welded sheet metal and said elongate suspension members are formed of bent sheet metal welded to said bottom and opposite pair of sides.

12. The apparatus of claim 11 wherein said suitable support is a support beam of a vehicle lift and said attachment means is L-shaped for hooking over said support beam.

13. The apparatus of claim 12 wherein said L-shaped attachment means is adjustable for fitting onto various sized supports.

14. The apparatus of claim 8 further including means for enabling retention of tools and parts within said tray.

15. A tool and parts tray apparatus comprising:

a shallow generally rectangular configured tray member formed of bent and welded sheet metal and having a bottom and opposite pairs of sides;

first and second generally identical elongate suspension members formed of sheet metal bent and welded to said bottom and to an opposite pair of sides of said tray member;

said suspension members having the lower ends thereof triangularly configured to provide a base portion of the triangle for affixing to said bottom, and for affixing to said sides a leg portion perpendicular to the bottom and a hypotenuse portion providing bracing to said leg;

said leg portion extending generally perpendicularly from said tray and having adjustable L-shaped attachment means at the distal ends thereof for adjustable attachment to various sized support beams of a vehicle lift; and said tray having means for enabling retention of tools and parts within said tray.

* * * * *